US006042028A

United States Patent [19]

Xu

[11] Patent Number: 6,042,028

[45] Date of Patent: Mar. 28, 2000

[54] DIRECT INJECTION FUEL INJECTOR SPRAY NOZZLE AND METHOD

[75] Inventor: Min Xu, Canton, Mich.

[73] Assignee: General Motors Corporation, Detroit, Mich.

[21] Appl. No.: 09/252,145

[22] Filed: Feb. 18, 1999

[51] Int. Cl.[7] ..... B05B 1/30; F02M 61/00

[52] U.S. Cl. ..... 239/585.1; 239/533.7; 239/5; 239/461; 239/533.3; 239/533.9; 239/533.12

[58] Field of Search ..... 239/5, 461, 463, 239/533.3, 533.7, 533.9, 533.11, 533.12, 585.1, 585.2, 585.3, 585.4, 585.5

[56] References Cited

U.S. PATENT DOCUMENTS

| | | | |
|---|---|---|---|
| 4,588,132 | 5/1986 | Neitz et al. | 239/453 |
| 4,708,289 | 11/1987 | Szablewski et al. | 239/125 |
| 4,730,785 | 3/1988 | Seifert | 239/533.3 X |
| 4,982,708 | 1/1991 | Stutzenberger | 239/533.12 X |
| 5,020,728 | 6/1991 | Linder et al. | 239/533.3 X |
| 5,887,798 | 3/1999 | Ohta et al. | 239/585.1 |
| 5,954,274 | 9/1999 | Sumida et al. | 239/585.5 X |

FOREIGN PATENT DOCUMENTS

| | | | |
|---|---|---|---|
| 91/11609 | 8/1991 | WIPO | 239/533.12 |

OTHER PUBLICATIONS

M. Pontoppidan, Direct Fuel Injection—A Study of Injector Requirements for Different Mixture Preparation Components, SAE International, International Congress & Exposition, Detroit, Michigan Feb. 24–27, 1997.

Fu–Quan Zhao, A Review of Mixture Preparation and Combustion Control Strategies for Spark–Ignited Direct Injection Gasoline Engines, SAE International, International Congress & Exposition, Detroit, Michigan, Feb. 24–27, 1997.

*Primary Examiner*—Lesley D. Morris
*Assistant Examiner*—Robin O. Evans
*Attorney, Agent, or Firm*—Vincent A Cichosz

[57] ABSTRACT

A direct injection fuel injector spray nozzle assembly and method of operation wherein the nozzle assembly comprises a three hole swirler with a central valve guide, a convergent swirl chamber, a conical nozzle valve and a conical valve seat. High pressure fuel at, for example, 10 MPa is delivered to the injector and passes through internal passages with a negligible pressure drop until reaching the nozzle assembly. The size, configuration and orientation of the swirl chamber and swirler holes are selected to achieve a desired swirl intensity at the nozzle exit. At least 30 percent and preferably about half of the fuel pressure, 5 MPa, is consumed in passing through the swirler holes and developing the swirl motion. The remaining pressure drop of at least 30 percent, preferably half, 5 MPa, occurs at the sealing point of the valve head against the valve seat. The outwardly opening conical injection valve and seat, together with the high pressure, combine to provide essentially separate control of the elements of fuel droplet size, spray penetration and spray angle. Swirl intensity adjusted by varying the swirler hole locations can serve as a primary control factor for spray penetration. The cone angles of the valve and seat act as a primary control for spray angle. Droplet size is directly affected by the valve opening which determines the liquid sheet thickness of fuel passing through the spray nozzle, as well as by the fuel pressure drop through the nozzle.

10 Claims, 4 Drawing Sheets

DIRECT INJECTION FUEL INJECTOR SPRAY NOZZLE AND METHOD

TECHNICAL FIELD

This invention relates to direct injection fuel injectors and, more particularly, to spray nozzles for use with such injectors.

BACKGROUND OF THE INVENTION

In order to provide for the direct injection of fuel such as gasoline into an engine combustion chamber, high fuel pressures are required to overcome compression pressures in the chamber and to generate very fine fuel atomization. The injector must solely prepare the fuel for combustion since the mixing of air and fuel must take place in the combustion chamber during the compression stroke. The time for injection of fuel is limited to the period after the intake valve is closed up to just before the point of ignition. These requirements are considerably more demanding than those of current common systems using port fuel injection. Required fuel pressures for direct injection are on the order of 10 MPa (about 1500 PSI) and fuel particles prior to combustion should be in the range of 15 micrometers or less. The window or time for injection is about ¼ of that for port fuel injection and thus requires a dynamic range (and static flow rate) which is about four times that of a typical port fuel injector.

Direct injection (DI) injectors must be located in the cylinder head. Prior embodiments of DI injectors have generally been larger than current port fuel injectors making it extremely difficult to mount them without compromising the engine cylinder head.

Typically, DI injectors have used inwardly opening pintle valves in combination with a fuel swirler. The fuel travels through the swirler and then through a single orifice before creating a spray. The fuel recombines in this orifice before the spray is created, making it difficult to achieve small particles as desired. Other DI systems have used outwardly opening pintle nozzles, relying on a pressurized air source to break up the fuel into small droplets. Such systems require an air pump and an additional actuator.

Inwardly opening pintle-type injectors may be affected by combustion chamber deposits which form in the exit orifice, disturbing the fuel spray and decreasing the flow rate. Further, combustion pressures can force a fuel valve to open if the fuel pressure is low and the pintle spring rate is low. Back flow from the combustion chamber can force particles into the injector, upsetting the spray formation and possibly sticking the injector open. Increasing spring load to insure that the injector won't allow back flow, adversely affects opening time as the actuator must overcome this load to open the injection valve.

Further information regarding the requirements of DI injectors as well as many details regarding development of the present invention may be found in SAE paper No. 980493 entitled "CFD-Aided Development of Spray for an Outwardly Opening Direct Injection Gasoline Injector" authored by Min Xu and Lee E. Markle, presented at the SAE International Congress and Exposition in Detroit, Mich., Feb. 23–26, 1998 and published by SAE International, Warrendale, Pa. The entire subject matter of this paper is hereby incorporated by reference into this patent application.

SUMMARY OF THE INVENTION

The present invention provides an outwardly opening spray nozzle assembly as implemented in a direct injection (DI) gasoline fuel injector. The injector is of a small size and produces an improved spray meeting critical gasoline DI requirements. The nozzle assembly comprises a three hole swirler with a central valve guide, a convergent swirl chamber, a conical nozzle valve and a conical valve seat. The assembly is screwed into the end of an injector housing which extends to a suitable location in the combustion chamber of a gasoline engine.

High pressure fuel at 10 MPa is delivered to the injector and passes through internal passages with a negligible pressure drop until reaching the nozzle assembly. Fuel passes to an annular inlet and through passages, such as three circular swirler holes to an internal swirl chamber adjacent the valve seat. The size, configuration and orientation of the swirl chamber and swirler holes are selected to achieve a desired swirl intensity at the nozzle exit. When the valve is fully opened, about half of the fuel pressure, 5 MPa, is consumed in passing through the swirler holes and developing the swirl motion. The remaining 5 MPa pressure drop occurs at the sealing point of the valve head against the valve seat. When the valve is opened fully to a constant seat gap of about 30 microns, the pressure drop forces a very thin liquid sheet of fuel out of the nozzle assembly as a hollow cone which quickly develops, after injection to the combustion chamber, into a hollow cone spray of small fuel droplets injected with a swirl that helps to control spray penetration.

During the valve opening and closing, the initial sheet thickness is small. The upstream pressure of the discharge orifice is greater than in the fully opened condition due to decreased pressure drop at the swirler. Therefore, the initial spray and the spray tail have even smaller droplets than the main spray.

The outwardly opening conical injection valve and seat, together with the high pressure, combine to provide essentially separate control of the elements of fuel droplet size, spray penetration and spray angle. Swirl intensity adjusted by varying the swirler hole locations can serve as a primary control factor for spray penetration. The cone angles of the valve and seat act as a primary control for spray angle. Droplet size is directly affected by the valve opening which determines the liquid sheet thickness of fuel passing through the spray nozzle, as well as by the fuel pressure drop through the nozzle.

These and other features and advantages of the invention will be more fully understood from the following description of certain specific embodiments of the invention taken together with the accompanying drawings.

DESCRIPTION OF THE PREFERRED EMBODIMENT

Figure 1:
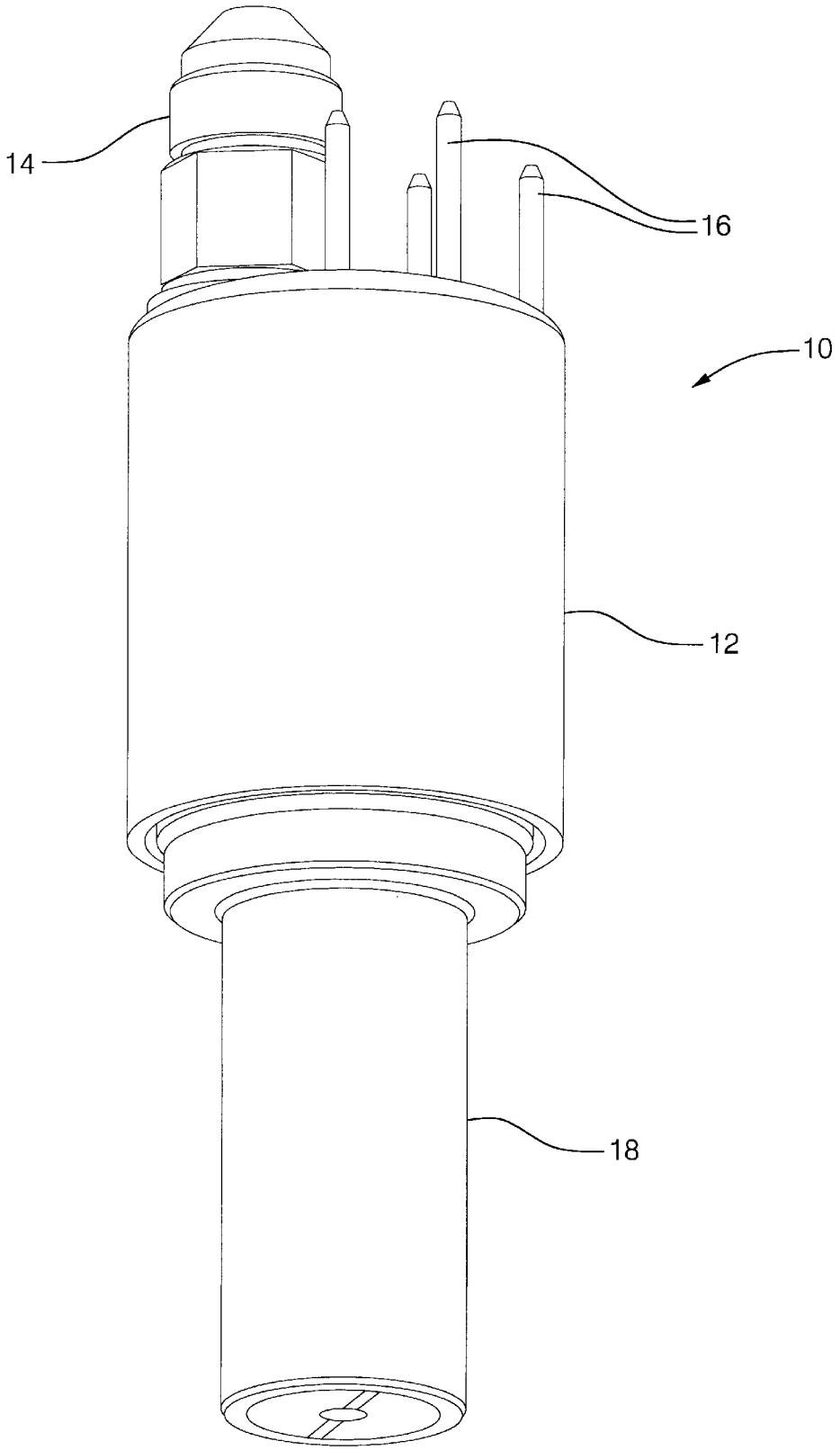
FIG. 1 is a pictorial view showing the external appearance of a gasoline fuel direct injection (DI) injector including a spray nozzle assembly in accordance with the invention.

Referring first to FIG. 1 of the drawings in detail, numeral 10 generally indicates a direct injection (DI) fuel injector having a spray nozzle assembly formed in accordance with the invention. Injector 10 includes a housing 12 having at an upper end a fuel inlet connector 14 and electrical connectors 16. At a lower end of the injector, a lower housing assembly 18 is provided extending upward into assembly with the injector housing 12. A detailed description of the internal construction of a fuel injector having similar structural and operating features to those of injector 10 may be found in co-pending U.S. patent application Ser. No. 09/049,183, filed Mar. 27, 1998. The complete disclosure of this prior application is hereby incorporated by reference into the present patent application.

Figure 2:
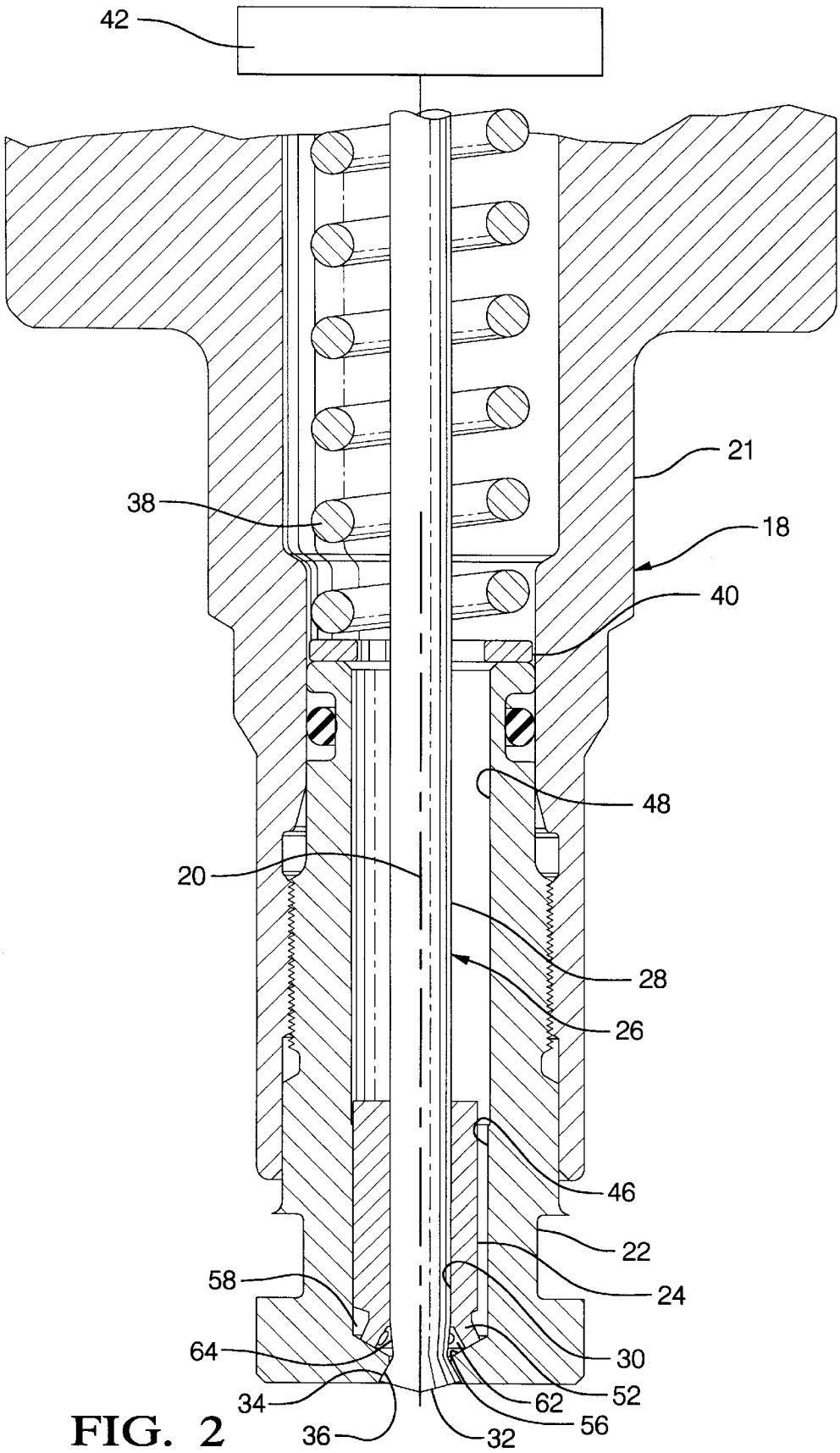
FIG. 2 is a cross-sectional view of a lower portion of the injector of FIG. 1 illustrating features of a lower housing and nozzle assembly.
Figure 3:
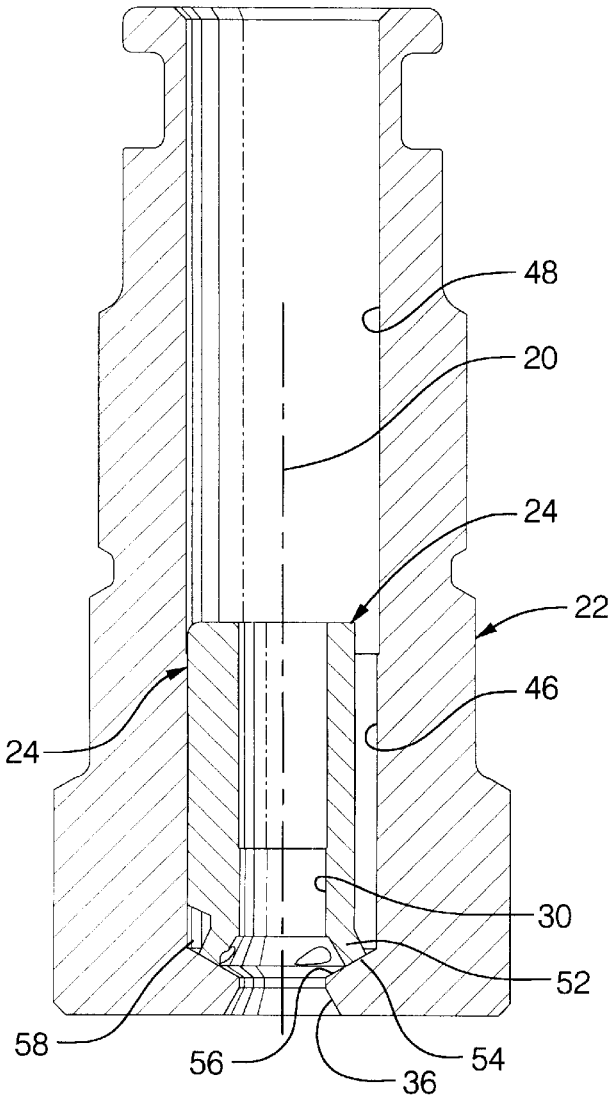
FIG. 3 is a cross-sectional view of a nozzle body assembled with a guide and swirler for the injector of FIG. 2.
Figure 4:
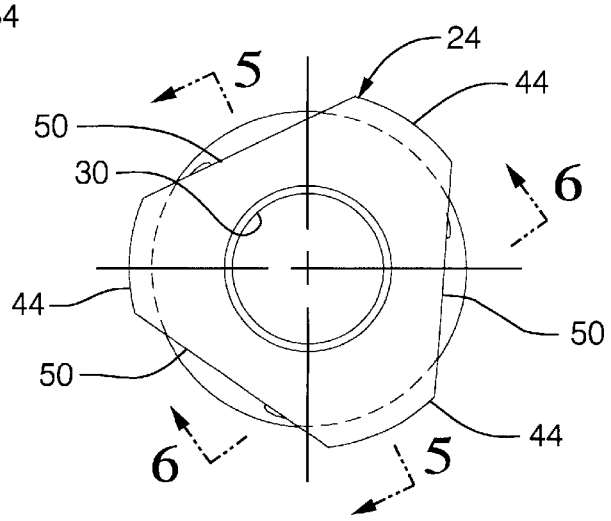
FIG. 4 is an upper end view of the guide and swirler of FIG. 3.
Figure 5:
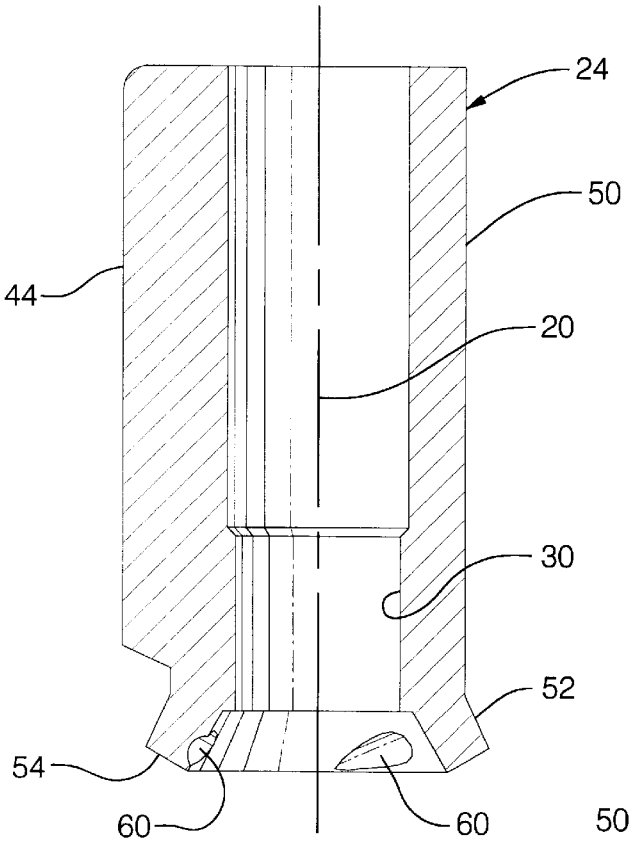
FIG. 5 is a cross-sectional view from the line 5—5 of FIG. 4 showing the internal bore and swirler configuration.
Figure 6:
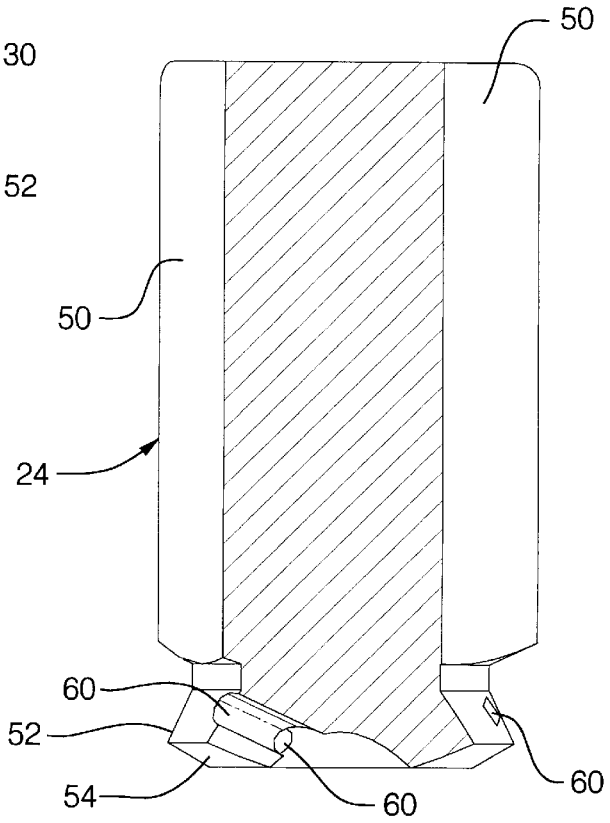
FIG. 6 is a partial cross-sectional view from the line 6—6 of FIG. 4 showing the configuration and location of one of the swirler holes.
Figure 7:
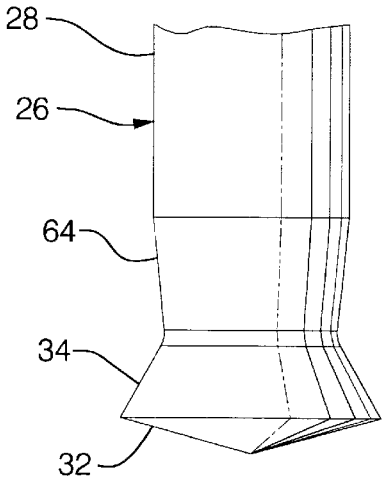
FIG. 7 is a fragmentary end view of the head end of the pintle valve in the assembly of FIG. 2.

Referring now to FIG. 2 of the drawings, there is shown a portion of the lower housing assembly 18 having an axis 20. Assembly 18 includes a lower housing 21 in which is mounted a nozzle body 22 having press-fitted therein a combined valve guide and swirler 24. A pintle valve 26 includes a pintle 28 that extends through and is guided by an axial bore 30 in the lower end of the valve guide and swirler 24 where a close clearance is provided to prevent significant fuel flow therethrough. Valve 26 includes a valve head 32 having a conical surface 34 which seats against a mating conical valve seat 36 formed in the end of the nozzle body 22.

A valve spring 38, seated against a washer 40 on the inner end of the nozzle body 22, extends upward to an abutment, not shown, that connects with the pintle 28 so that the spring 38 applies an upward biasing force on the pintle 28 urging the valve head against its seat in a valve closing direction. A magnetic actuator or solenoid, indicated by box 42, is provided to actuate the valve in an opening direction as well as to assist the spring in quickly closing the valve when the end of the injection period has been reached. Details of the solenoid actuating arrangement are described in the previously mentioned U.S. patent application Ser. No. 09/049,183.

Referring now in particular to FIGS. 2–6, the valve guide portion of guide and swirler 24 has a generally triangular body with three edges 44 having part cylindrical surfaces that are press-fitted into a slightly reduced bore diameter 46 at the lower end of a bore 48 extending from the upper end to adjacent the lower end of the nozzle body 22. The part cylindrical edges 44 of the valve guide 24 are interrupted by three flats 50 which form longitudinal passages between the flats and the smaller bore diameter 46 for the passage of fuel past the exterior of the valve guide to the swirler portion at the lower end of the valve guide and swirler 24.

The swirler portion is defined by an annular wall 52 which extends downward with a conically outward configuration. The wall 52 terminates in an inwardly sloping conical surface 54 which engages a corresponding mating surface 56 forming a seat adjacent the lower end of the nozzle body 22. Externally, the annular wall 52 defines, with the bore diameter 46 and the conical mating surface 56, an annular inlet 58 into which fuel passing through the injector is delivered. From the inlet 58 the fuel passes through three downwardly angled tangential swirler holes 60. These extend through the wall 52 to a swirl chamber 62 defined between the wall 52 and a slightly inwardly angled portion 64 of the pintle 28 adjacent the valve head 32. The swirler holes 60 are angled to connect tangentially with the swirl chamber 62 so that fuel passing through the opening 60 is directed in a rapid swirling motion about the valve pintle at the angled portion 64.

In operation, fuel enters the injector through connector 14 and is passed through relatively open passages into the lower housing 21 (FIG. 2) where it is directed past the spring 38 and through washer 40 into the bore 48 of the nozzle body 22. In the preferred embodiment described, the fuel pressure is preferably maintained at a level of about 10 MPa (1500 psi) as it passes through the injector and into the passages defined by flats 50 of the valve guide and swirler 24 to reach the annular inlet 58. The swirler holes 60 are sized to provide a substantial portion of the total pressure drop of fuel through the injector, which should be at least 30 percent of the pressure drop and, in the embodiment described, is targeted at 50 percent or 5 MPa. In this particular embodiment, the swirler holes were sized at 0.3 mm. If desired, swirler holes of other sizes, shapes or numbers could substituted as could slots or other forms of swirler passages.

During transient valve opening and closing conditions, the swirl pressure drop is reduced with the lower flow rates. Thus, greater pressure drop occurs across the nozzle which provides good atomization and smaller droplet sizes during these transient conditions. At full opening, the pressure drop through the swirl openings accelerates the fuel to a rapid swirling flow around the valve pintle as the valve is opened a predetermined small amount sufficient to create a gap of about 30 microns between the upper end of the valve seat and the associated upper end of the valve head conical surface 34. In the disclosed embodiment, the valve seat is formed with a nominal 60 degree cone angle and the valve head is formed with a nominal 59 degree cone angle so that the smallest clearance between the valve head and seat when the valve is open is located at the upper end of the head and seat. If desired, the cone angle differential could be varied or even reversed so that sealing contact occurs at the large end of the valve.

The swirling fuel is thus directed from the swirl chamber 62 downward in a swirling conical sheet through the narrow clearance at the smallest area between the valve and seat. The fuel expands outwardly in the cone as it moves downward and outward, the swirl causing the sheet of fuel to become thinner and to hug the surface of the valve seat 36 as the fuel passes downward through the conical clearance and the area of the clearance increases. The fuel is then expelled from the nozzle into the engine combustion chamber with a still swirling thin conical sheet which quickly breaks up into small droplets having a Sauter mean diameter (SMD) averaging less that 15 microns at 30 mm distance from the nozzle. At this point, 90 percent of total liquid volume is in drops of less than 40 microns. The maximum penetration is about 70 mm into air at atmospheric pressure. An initial spray slug is not created due to the absence of a sac volume.

A high performance DI fuel injector nozzle assembly is thus provided for DI injectors. The assembly provides control of fuel droplet size, spray penetration and spray angle which may be separately controlled for a specific application by varying the fuel pressure, valve and seat cone angles and the valve opening as well as the size and orientation of the swirler holes.

While the invention has been described by reference to certain preferred embodiments, it should be understood that numerous changes could be made within the spirit and scope of the inventive concepts described. Accordingly it is intended that the invention not be limited to the disclosed embodiments, but that it have the full scope permitted by the language of the following claims.

I claim:

1. A spray nozzle assembly for a direct injection fuel injector, said assembly comprising:

a nozzle body having an axial bore extending from an inlet end and having a conical guide seat adjacent an outlet end, the guide seat extending to a reduced nozzle opening communicating with an outwardly angled conical valve seat that opens through the outlet end;

a swirler seated against the conical guide seat;

a valve guide adjacent the swirler;

a pintle valve having a pintle extending through and radially guided for reciprocating motion in the valve guide and a conical valve head with an outwardly angled conical surface engagable with the valve seat;

a spring urging the valve in a closing direction toward the valve seat; and magnetic means operable to move the valve against the spring and open the valve a small amount that creates a predetermined conical gap between the valve head and the valve seat for the passage of fuel therethrough in a thin conical sheet;

the valve guide engaging the axial bore and centering the pintle valve on a common axis with the valve seat and the bore, the valve guide defining at least one longitudinal fuel passage between the guide and the bore and extending to the swirler;

the swirler forming an annular wall between the guide and the guide seat and including a plurality of swirler holes therethrough, the wall defining an annular inlet between the swirler and the bore, and an annular swirl chamber between the swirler and the pintle, the annular inlet communicating with said at least one longitudinal fuel passage to deliver fuel to the swirler holes and the swirler holes being angled to open tangentially into the swirl chamber to direct fuel delivered thereto into a toroidal motion in the swirl chamber;

the swirl holes and the conical gap being sized relative to other fuel passages in the assembly to provide nearly all of the fuel pressure drop through the nozzle assembly when the valve is open for fuel flow.

2. A spray nozzle assembly as in claim 1 wherein at least 30 percent of the fuel pressure drop occurs in the swirler for creating swirl and at least 30 percent of the fuel pressure drop occurs in the conical gap for generating an atomized fuel spray.

3. A spray nozzle assembly as in claim 2 wherein nearly 50 percent of the pressure drop occurs in each of the swirler and the conical gap.

4. A spray nozzle assembly as in claim 1 wherein the valve guide and the swirler are combined in an integral component.

5. A spray nozzle assembly as in claim 1 wherein the conical valve head of the pintle valve has an included angle that is no greater than a corresponding angle of the conical valve seat in the nozzle body so that sealing contact of the valve and seat will always occur at the smallest diameter of their facing surfaces.

6. A spray nozzle assembly as in claim 1 wherein the swirler holes are angled slightly downward from the annular inlet to the swirl chamber.

7. A method of creating a fuel spray in a combustion chamber of a direct injected internal combustion engine, said method comprising:

providing fuel to a fuel injector at a pressure adequate to deliver an atomized fuel spray directly to the engine combustion chamber during the engine compression stroke;

creating toroidal swirl of the fuel in a swirl chamber of the injector upstream of an outwardly opening conical injection valve using between about 30 and 70 percent of the fuel pressure drop in the injector to create the swirl; and spraying the swirling fuel from the swirl chamber through a small conical gap of the open injection valve using the remaining approximately 70 to 30 percent of the pressure drop through the injector to first accelerate the fuel in a swirling conical sheet through the smallest area of the gap and direct the fuel through the expanding flow path downstream so the fuel conical sheet of fuel becomes thinner while still in the conical valve and then forms a conical spray of atomized droplets upon entering the combustion chamber.

8. A method as in claim 7 wherein nearly 50 percent of the fuel pressure drop through the injector is caused to occur in each of the steps of creating toroidal swirl and spraying the swirling fuel through the valve.

9. A method as in claim 7 including the step of assuring that the conical gap has a minimum thickness at the smallest diameter of the facing surfaces.

10. A method as in claim 7 including the step of directing the fuel flow into the swirl chamber slightly downward to maintain a general direction of downward flow through the injector and minimize the loss of fuel flow inertia through the injector.

* * * * *